US007029229B2

(12) United States Patent
Iwase et al.

(10) Patent No.: US 7,029,229 B2
(45) Date of Patent: Apr. 18, 2006

(54) AXIAL FLOW FAN

(75) Inventors: Taku Iwase, Tsuchiura (JP); Kazuyuki Sugimura, Chiyoda (JP); Taro Tanno, Kiryu (JP)

(73) Assignees: Hitachi, Ltd., Tokyo (JP); Japan Servo Co., Ltd., Tokyo (JP)

( * ) Notice: Subject to any disclaimer, the term of this patent is extended or adjusted under 35 U.S.C. 154(b) by 132 days.

(21) Appl. No.: 10/840,367

(22) Filed: May 7, 2004

(65) Prior Publication Data

US 2004/0253103 A1 Dec. 16, 2004

(30) Foreign Application Priority Data

May 12, 2003 (JP) ..... 2003-132543

(51) Int. Cl.
*F04D 29/38* (2006.01)

(52) U.S. Cl. ..... 415/1; 415/178; 415/221; 416/243; 416/DIG. 5

(58) Field of Classification Search ..... 415/1, 415/177, 178, 221, 220; 416/223 R, 243, 416/DIG. 2, DIG. 5
See application file for complete search history.

(56) References Cited

U.S. PATENT DOCUMENTS 4,135,858 A * 1/1979 Entat ..... 416/223 R
4,840,541 A * 6/1989 Sakane et al. ..... 416/223 R
6,027,307 A * 2/2000 Cho et al. ..... 415/173.5

FOREIGN PATENT DOCUMENTS

| | | |
|---|---|---|
| JP | 61-190198 | 8/1986 |
| JP | 2-2000 | 1/1990 |
| JP | 6-129397 | 5/1994 |
| JP | 8-303391 | 11/1996 |
| JP | 9-49500 | 2/1997 |
| JP | 11-44432 | 2/1999 |
| JP | 2002-257088 | 9/2002 |

OTHER PUBLICATIONS

Namai, et al., "Turbo-fan and compressor", Published Aug. 25, 1988, pp. 357-418 and English language translation.

* cited by examiner

*Primary Examiner*—Ninh H. Nguyen
(74) *Attorney, Agent, or Firm*—Antonelli, Terry, Stout and Kraus, LLP.

(57) ABSTRACT

An axial flow fan of high efficiency and low noise level is provided. The fan includes a motor, an impeller having a plurality of blades around a hub fitted to the motor, and a fan casing having an air inlet on one side and an air outlet on the other, wherein a radial position with a maximum setting angle in a blade section, and a radial position with a contour of a leading edge portion in a fluid flowing direction forming a projecting apex in the flowing direction are located between 60% and 80% of the outside diameter of the impeller.

18 Claims, 14 Drawing Sheets

AXIAL FLOW FAN

BACKGROUND OF THE INVENTION

1. Field of the Invention

The present invention relates to an axial flow fan used as a fan for electronic devices, and more specifically, it relates to a structure of an axial flow fan suitable for high efficiency and low noise level.

2. Description of the Related Art

An axial flow fan is used for various kinds of appliances such as a fan for cooling electronic devices and an outdoor unit of air-conditioners, and a variety of technologies have been developed for realizing high efficiency and low noise level thereof.

As for a fan casing, there is a technology for reducing the noise level by forming a cylindrical inlet of the fan casing and forming an axisymmetric suction flow (for example, refer to Patent Document 1).

As for a fan shape, there is provided a technology of realizing high efficiency and low noise level by forming a triangular leading edge at a blade tip by advancing the edge in a rotational direction, tilting the blade toward an inlet side, or designing the camber and the setting angle to be in an adequate range to reduce tip vortexes and leak flow (for example, refer to Patent Documents 2 to 5).

There is further provided a technology of realizing low noise level by improving a shape of a blade tip (for example, refer to Patent Document 6).

There is still further provided a technology of realizing high efficiency by improving a shape of a trailing edge (for example, refer to Patent Document 7).

Patent Document 1

Japanese Unexamined Patent Application Publication No. 61-190198 (Pages 2 to 3, FIGS. 1 to 3)

Patent Document 2

Japanese Unexamined Patent Application Publication No. 61-065096 (Pages 5 to 6, FIGS. 1 and 2)

Patent Document 3

Japanese Unexamined Patent Application Publication No. 09-049500 (Pages 13 to 14, FIGS. 1 to 7)

Patent Document 4

Japanese Unexamined Patent Application Publication No. 11-044432 (Pages 4 to 6, FIGS. 1 to 7)

Patent Document 5

Japanese Unexamined Patent Application Publication No. 08-303391 (Page 2, FIGS. 1 to 5)

Patent Document 6

Japanese Unexamined Patent Application Publication No. 06-129397 (Page 3, FIGS. 1 to 3)

Patent Document 7

Japanese Unexamined Patent Application Publication No. 2002-257088 (Page 4, FIGS. 1 and 2) Non-Patent Document 1

"Turbo-fan and compressor" by NAMAI, Takefumi and INOUE, Masahiro Corona, Published on Aug. 25, 1988, pp357–418

Technical development of the axial flow fan has been advancing for a long time, and the axial flow fan has become a well-developed mechanical element. In the related art described above, sufficient effects have been achieved in realizing high efficiency and low noise level thereof.

However, these technologies have been focused on the versatility, and further improvement in performance has been difficult.

Most of the fans for cooling devices are mass-produced, in other words, catalog products, and it is difficult to specify service conditions and applications (Patent Documents 1 and 5).

Therefore, a design has been specified so that the sucked flow and the discharged flow are in the axial flow direction parallel to the rotation axis. More specifically, more work is done at a tip portion of a blade, in other words, at a blade tip. The pressure gradient is generated with the flow at the tip portion of the blade in a high pressure, the flow expanding outwardly by the centrifugal force of the rotation is suppressed, and allowed to flow in the axial flow direction.

Even in the axial flow fan used for air-conditioners, the flow is designed to flow in the axial flow direction similar to the above in order to avoid any circulation phenomenon that the discharged flow is sucked in again (Patent Documents 2 to 4, 6 and 7).

In a general structure of these axial flow fans, an adequate tip clearance is ensured between the tip and the fan casing. When the impeller is rotated, tip vortexes and leak flow occur in the tip clearance due to the pressure difference between the pressure surface and the suction surface of the blade and the pressure difference between the suction side and the discharge side, and cause losses and noise.

In addition, a boundary layer of the fan casing is twisted by the flow field between a stationary fan casing wall surface and the rotating impeller, the flow is interfered with tip vortexes, leak flow or the like at the tip clearance, and the flow becomes very complex.

However, the tangential velocity is largest, and more work is done at the tip portion. Therefore, most of the known axial flow fans have been designed with design scheme of doing more work by such complex flows at the tip portion.

As described above, more work means that the absolute value of losses is large even it is assumed that the ratio of the energy taken out of the input energy is unchanged. In other words, setting the flow in the axial direction and reduction of losses and noise at the tip portion are in a trade-off relationship, and a problem occurs when realizing higher efficiency and lower noise level.

SUMMARY OF THE INVENTION

Accordingly, it is an object of the present invention to provide an axial flow fan with a fan shape that reduces tip vortexes, leak flow or the like at a blade tip portion causing losses and noise, a method for using the axial flow fan, and a heat sink with the axial flow fan.

In order to achieve the above object, according to a first aspect of the invention, there is provided an axial flow fan including a motor, an impeller having a plurality of blades around a hub fitted to the motor, and a fan casing having an air inlet on one side and an air outlet on the other is provided, in which a radial position with a maximum setting angle $\xi$ in a blade section, and a radial position Aa with a contour of a leading edge portion in a fluid flowing direction forming a projecting apex in the flowing direction are located between 60% and 80% of the outside diameter of the impeller.

According to a second aspect of the invention, there is provided an axial flow fan including a motor, an impeller having a plurality of blades around a hub fitted to the motor, and a fan casing having an air inlet on one side and an air outlet on the other is provided, in which a radial position with a maximum setting angle ξ in a blade section, and a radial position with a maximum chord-pitch ratio σ when the chord-pitch ratio σ is defined as σ=L/T, where L is a length of a chord line to connect a leading edge to a trailing edge of the blade, and T is a pitch of a circumferential length at the radius R divided by the blade number Z, are located between 60% and 80% of the outside diameter of the impeller.

According to a third aspect of the invention, there is provided an axial flow fan including a motor, an impeller having a plurality of blades around a hub fitted to the motor, and a fan casing having an air inlet on one side and an air outlet on the other is provided, in which a radial position with a maximum setting angle ξ in a blade section, a radial position Aa with a contour of a leading edge portion in a fluid flowing direction forming a projecting apex in the flowing direction, and a radial position with a maximum chord-pitch ratio σ when the chord-pitch ratio σ is defined as σ=L/T, where L is a length of a chord line to connect a leading edge to a trailing edge of the blade, and T is a pitch of a circumferential length at the radius R divided by the blade number Z, are located between 60% and 80% of the outside diameter of the impeller.

An air outlet of the fan casing preferably has an inner surface communicating with an opening end in an expanding manner.

The maximum blade thickness tt of a tip portion is larger than the maximum blade thickness th of a hub part when the blade is cut by a cylindrical plane of the radius R, and the section is expanded in a two-dimensional plane.

When an object to be cooled is placed on an outlet side of the axial flow fan, the object is preferably projected at a position of the radius larger than the tip portion radius Rt on the air outlet side of the axial flow fan.

In the present invention, there is also provided a heat sink with an axial flow fan including any one of the above axial flow fan and a heat sink placed on an outlet side of the axial flow fan at the position projecting from the tip portion radius Rt.

According to the present invention, an axial flow fan with the fan shape that reduces tip vortexes and/or leak flow at the blade tip portion causing losses and noise can be obtained.

Further, devices of high efficiency and low noise level can be realized if the axial flow fan of the present invention is used.

In addition, for the heat sink with the axial flow fan, a high cooling effect is obtained by improving the arrangement of the axial flow fan and/or the heating body even when an object to be cooled is placed on the fan outlet side, and devices of high efficiency and low noise level with the axial flow fan assembled therewith can be realized.

DESCRIPTION OF THE PREFERRED EMBODIMENTS

Next, the axial flow fan according to the present invention and the embodiments of a method for using the axial flow fan will be described with reference to FIGS. 1 to 17.

First Embodiment

Figure 1:
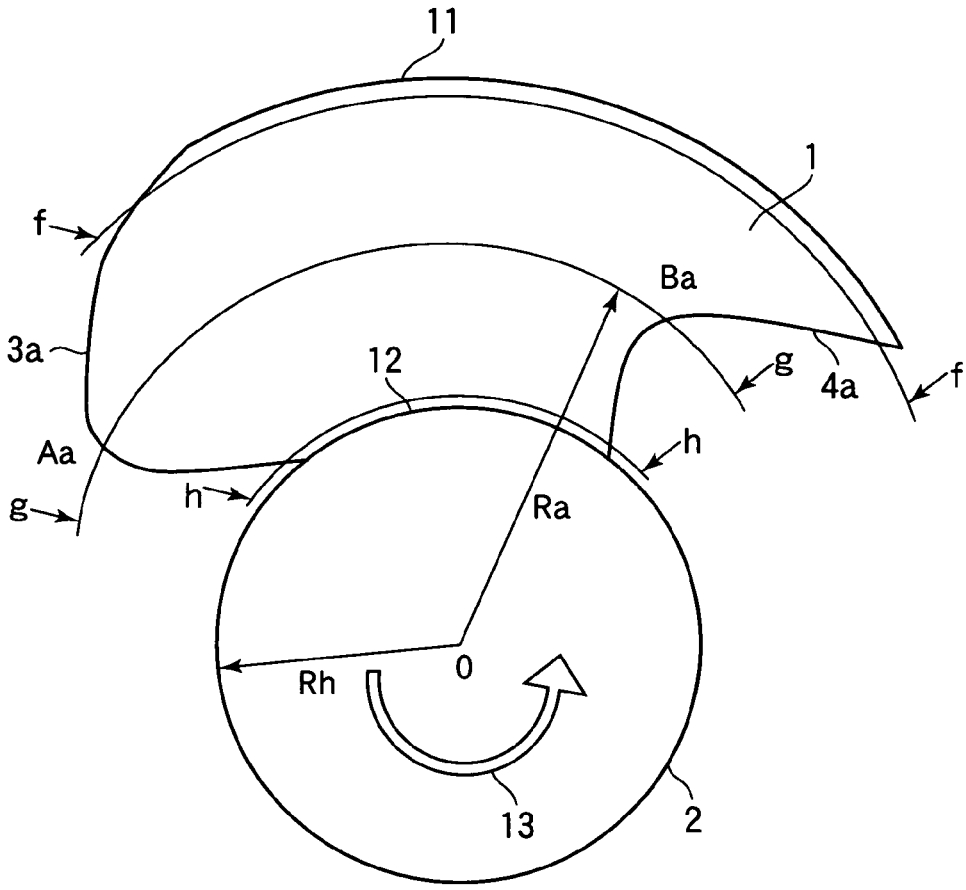
FIG. 1 is a projection of an axial flow fan according to a first embodiment of the present invention projected on a plane perpendicular to the rotation axis.

FIG. 1 is a projection of an axial flow fan according to a first embodiment projected on a plane perpendicular to the rotation axis.

In the axial flow fan according to the first embodiment, a plurality of blades 1 are fitted to the hub 2. A shape of the blade 1 is regulated by a leading edge contour 3*a*, a trailing edge contour 4*a*, a tip contour 11, and a hub contour 12. The axial flow fan is rotated in a direction of an arrow 13. A suction surface 6 is on a back side of the plane of the figure, and a pressure surface 7 is located on a face side of the plane of the figure.

Figure 2:
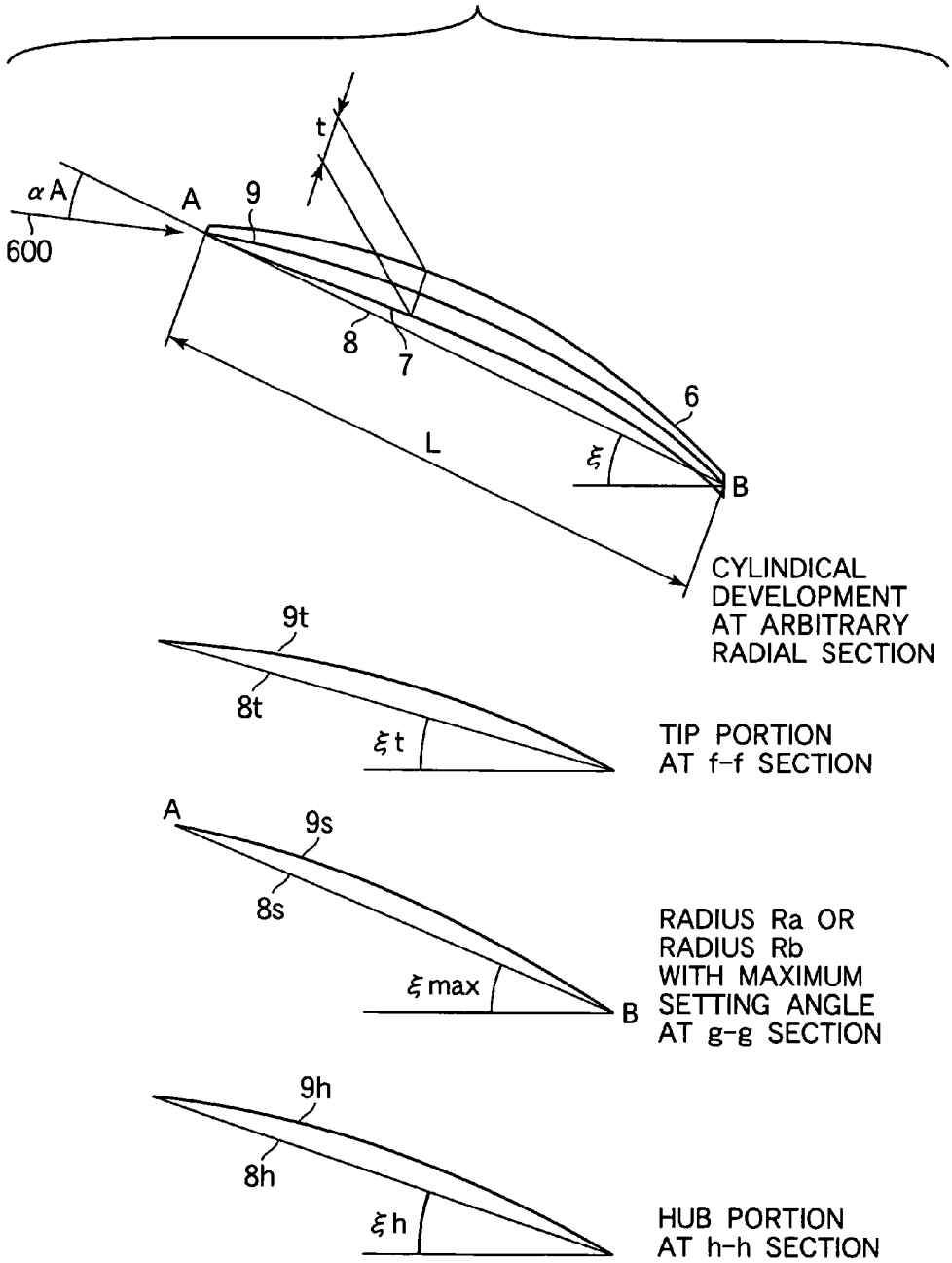
FIG. 2 includes an expansion plan obtained by cutting a blade by a cylindrical plane of an arbitrary radius and expanding the section in a two-dimensional plane, and sectional views showing sections at a hub part, the radius Ra with a maximum setting angle ξ and a tip portion.

FIG. 2 includes an expansion plan obtained by cutting a blade by a cylindrical surface at an arbitrary radius, and expanding the section in a two-dimensional plane, and sectional views to show the sections at a hub part, the radius Ra with the maximum setting angle, and the tip portion.

A leading edge A is an intersection of the leading edge contour 3 with the cylindrical surface in FIG. 1, and a trailing edge B is an intersection of the trailing edge contour 4 with the cylindrical surface. The cylindrical expansion plan in FIG. 2 shows a suction surface 6, a pressure surface 7, a chord line 8 to connect the leading edge A to the trailing edge B, and a camber line 9.

The length of the chord line 8 is defined as L, and the angle formed between the chord line 8 and a line passing the trailing edge B on a plane perpendicular to the rotation axis is defined as the setting angle ξ.

FIG. 2 shows the camber line 9 and the chord line 8 at an f—f section (in a vicinity of a tip portion) shown in FIG. 1, a g—g section (at the radius with the maximum setting angle), and an h—h section (in a vicinity of the hub portion). Suffixes t, h and max denote the tip portion, the hub portion and the portion with the maximum setting angle, respectively.

The development in FIG. 2 shows a so-called blade profile. Generally speaking, the blade profile has an effect that air flows in from a direction of an arrow 600, an attack angle αA is formed by the chord line 8, and the lift is obtained. The lift obtained by the blade profile is increased with the attack angle αA in a substantially straight manner, and rapidly decreased when the attack angle reaches a specified value. The attack angle in this condition is referred to as a stall angle.

The stall angle and the characteristic of the obtained lift depend on the kind of the blade profile, in other words, the distribution of the blade thickness, the camber line and the like. The shape of the axial flow fan using the blade profile must be designed within an effective attack angle αA considering the stall angle, and detailed data and design methods have been proposed (refer to Non-Patent Document 1).

Figure 3:
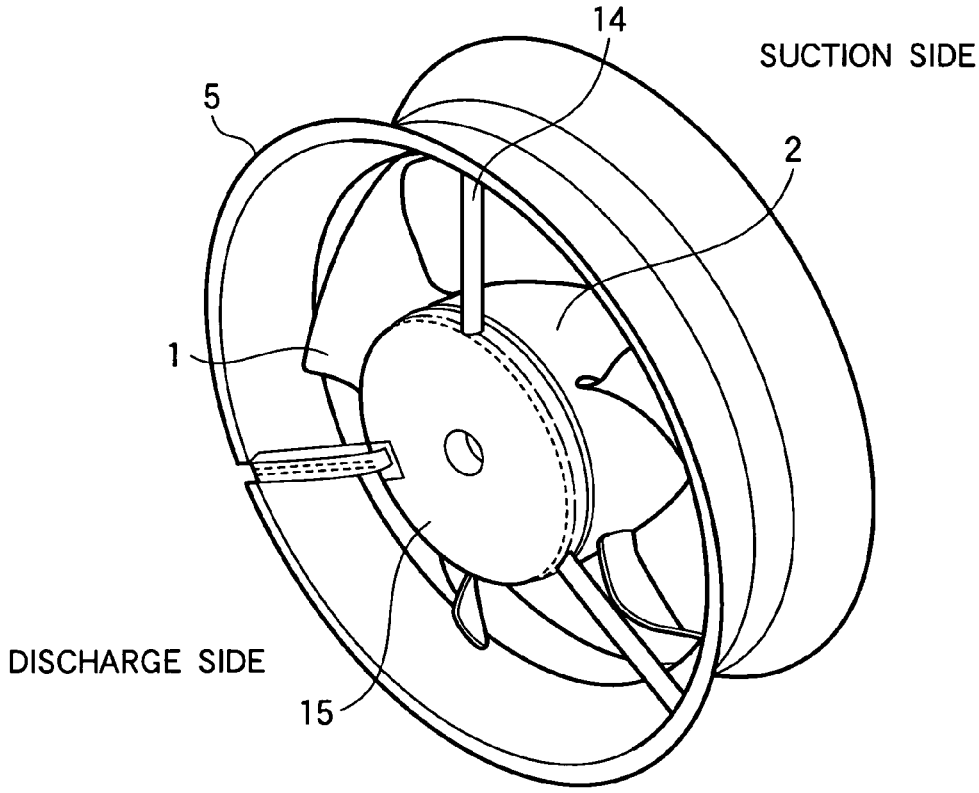
FIG. 3 is a perspective view of an assembly of an impeller of the axial flow fan with a fan casing according to the first embodiment.

FIG. 3 is a perspective view of an assembly of an impeller of the axial flow fan with a fan casing according to the first embodiment.

In FIG. 3, the hub 2 is fitted to a motor stored in a motor case 15. The motor case 15 is connected to the fan casing 5 by struts 14. The diameter of the hub 2 is about 50% of the outside diameter of the impeller.

FIG. 3 shows three stays and five blades 1. The present invention is not limited to this example. The fan casing 5 has a cylindrical shape, and flanges and/or ribs may be added so as to be fitted to a device.

In the first embodiment, the radius at an apex Aa with the leading edge contour 3*a* projecting in the flow-in direction and the radius with the maximum setting angle ξ have the same value Ra.

As described in the related art, known axial flow fans have been designed with design scheme of doing more work by the tip portion.

On the other hand, in the present invention, more work is done by a middle portion of the blade while reducing the work by the tip portion.

Since the middle portion of the blade is hardly influenced by the hub, the tip clearance, the fan casing or the like, the absolute loss by the tip portion can be reduced compared with that by a known design scheme of doing more work by the tip portion.

In order to realize high efficiency, as shown in FIG. 2, the setting angle ξ is maximized at the radius of 60%–80% of the outside diameter of the impeller to sustain a large amount of work, i.e., a large lift.

That the setting angle ξ is large means that the attack angle αA is large when flow rate is low. Though a large lift can be obtained, the attack angle is brought close to the above stall angle, and the flow can be separated.

Thus, in the present invention, as shown in FIGS. 1 and 2, the stall is suppressed by setting the radius at the projecting apex Aa and the radius at the maximum setting angle to be a substantially same value Ra.

Figure 4:
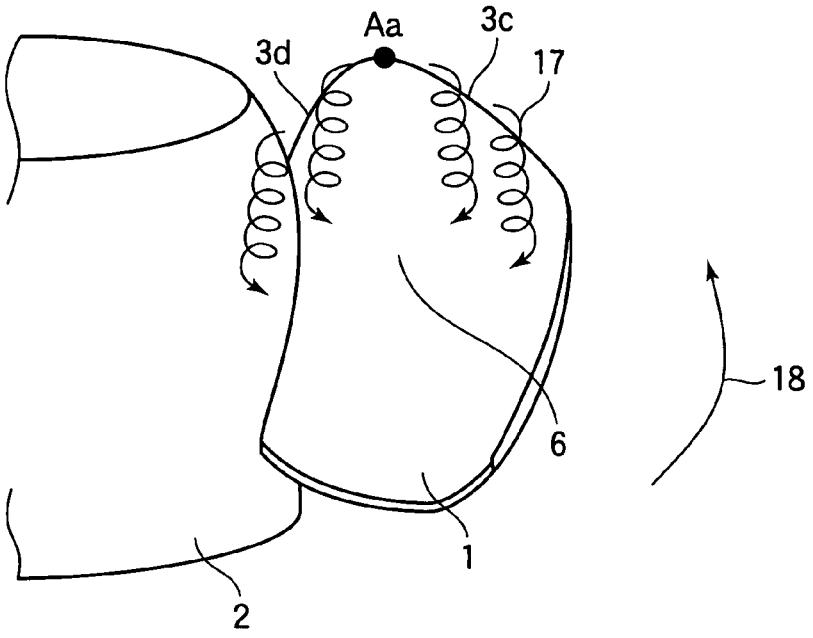
FIG. 4 is an obliquely perspective view of a rotating state of the impeller of the axial flow fan according to the first embodiment from an upper part of a suction side in order to illustrate an effect of suppressing stall.

FIG. 4 is an obliquely perspective view of a rotating state of the impeller of the axial flow fan according to the first embodiment from an upper part of a suction side in order to illustrate an effect of suppressing stall.

The blade 1 is rotated in a direction of an arrow 18 with the apex Aa at the most upstream position in the flow-in direction.

The leading edge contour 3 has a delta wing shape when it is divided into a tip side contour 3*c* and a hub side contour 3*d* with the point Aa as an apex. In other words, the blade 1 is in a similar state to that a delta wing is placed in a uniform flow.

At low flow rate, the attack angle αA is further increased at the radius Ra, and reaches the stall angle. However, the flow is rolled in by the leading edge, and reaches the suction surface 6 by the vortex 17 generated on the tip side contour 3*c* and the hub side contour 3*d*.

This phenomenon is an effect similar to that of a delta wing craft which can stably fly with a large attack angle at a low speed. Accordingly, most work is done at the radius Ra without any stall, and high efficiency and low noise level can be effectively realized in the low flow rate area.

In the known axial flow fan, the attack angle αA becomes excessively large in the low flow rate area, and the attack angle reaches the stall angle, the lift is reduced, and the pressure is dropped, resulting in unstable characteristics.

In the first embodiment, the stall is suppressed by the effect of the delta wing, and unstable characteristics can be reduced.

Figure 5:
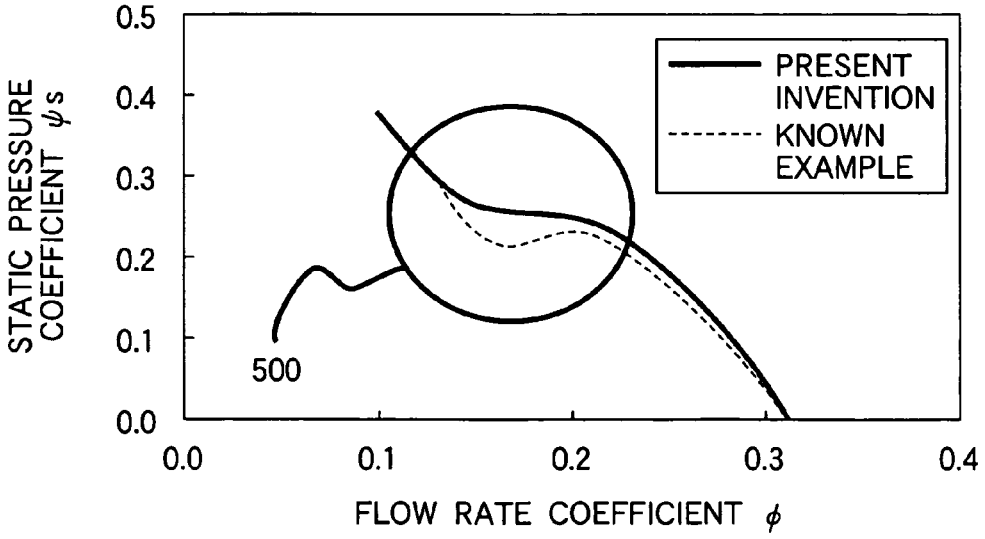
FIG. 5 shows comparison of a characteristic of the axial flow fan according to the first embodiment with a characteristic of a known axial flow fan.

FIG. 5 shows comparison of the characteristic of the axial flow fan according to the first embodiment with the characteristic of the known axial flow fan. The axial flow fan according to the first embodiment can avoid pressure drop which has occurred at the low flow rate state 500.

Figure 6:
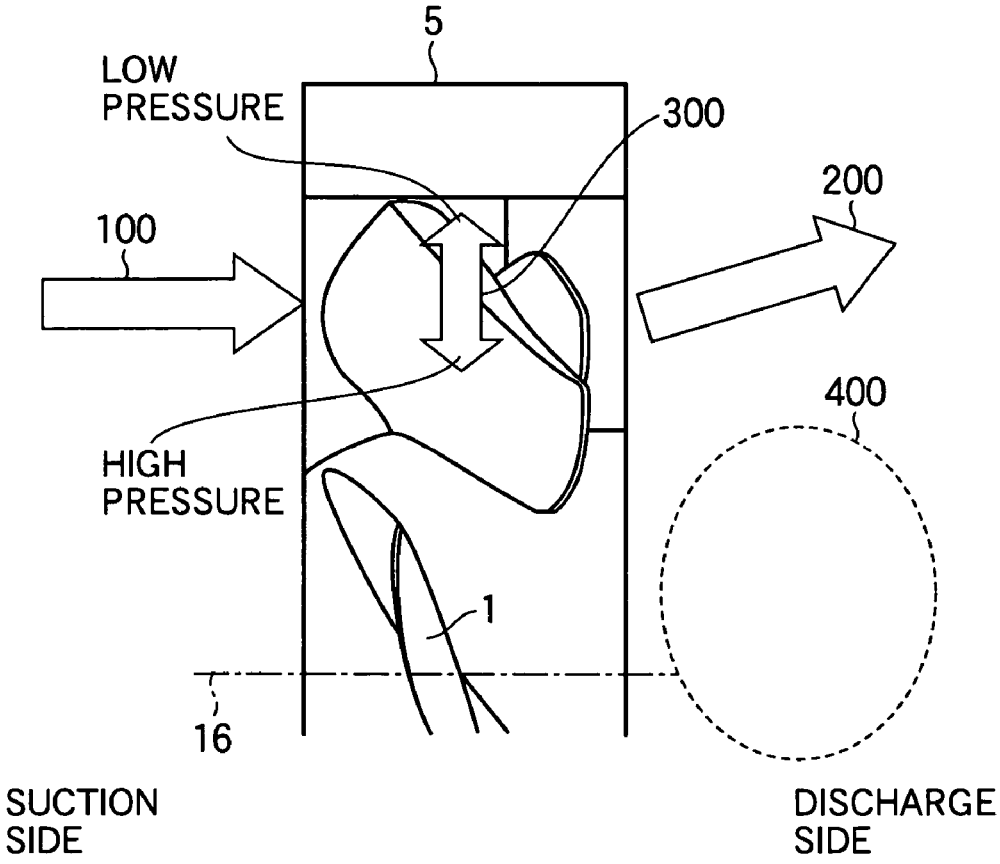
FIG. 6 shows air flow when the axial flow fan according to the first embodiment is operated.

FIG. 6 shows the air flow when the axial flow fan according to the first embodiment is operated.

In a case of the axial flow fan with the design scheme of doing a large amount of work by the middle portion of the blade as shown in the first embodiment, the sucked flow is slightly bent outwardly in the radial direction. When the structure according to the first embodiment is applied, the work (the pressure) by the tip portion is reduced, and the pressure gradient 300 occurs.

The flow 100 flowing in from the suction side parallel to the rotation axis 16 is boosted by the rotation of the blades 1 within the fan casing 5, and bent outwardly in the radial direction by the pressure gradient 300, and flows out in a direction of a flow 200 on the discharge side. Therefore, air in an area 400 on the discharge side easily stays slightly.

The radius Ra is preferably identical as in the first embodiment. However, it may be slightly deviated from each other due to the convenience of the device design and manufacturing errors. The advantage of the present invention can be demonstrated so long as the radius Ra is between 60% and 80% of the outside diameter of the impeller.

Second Embodiment

Figure 7:
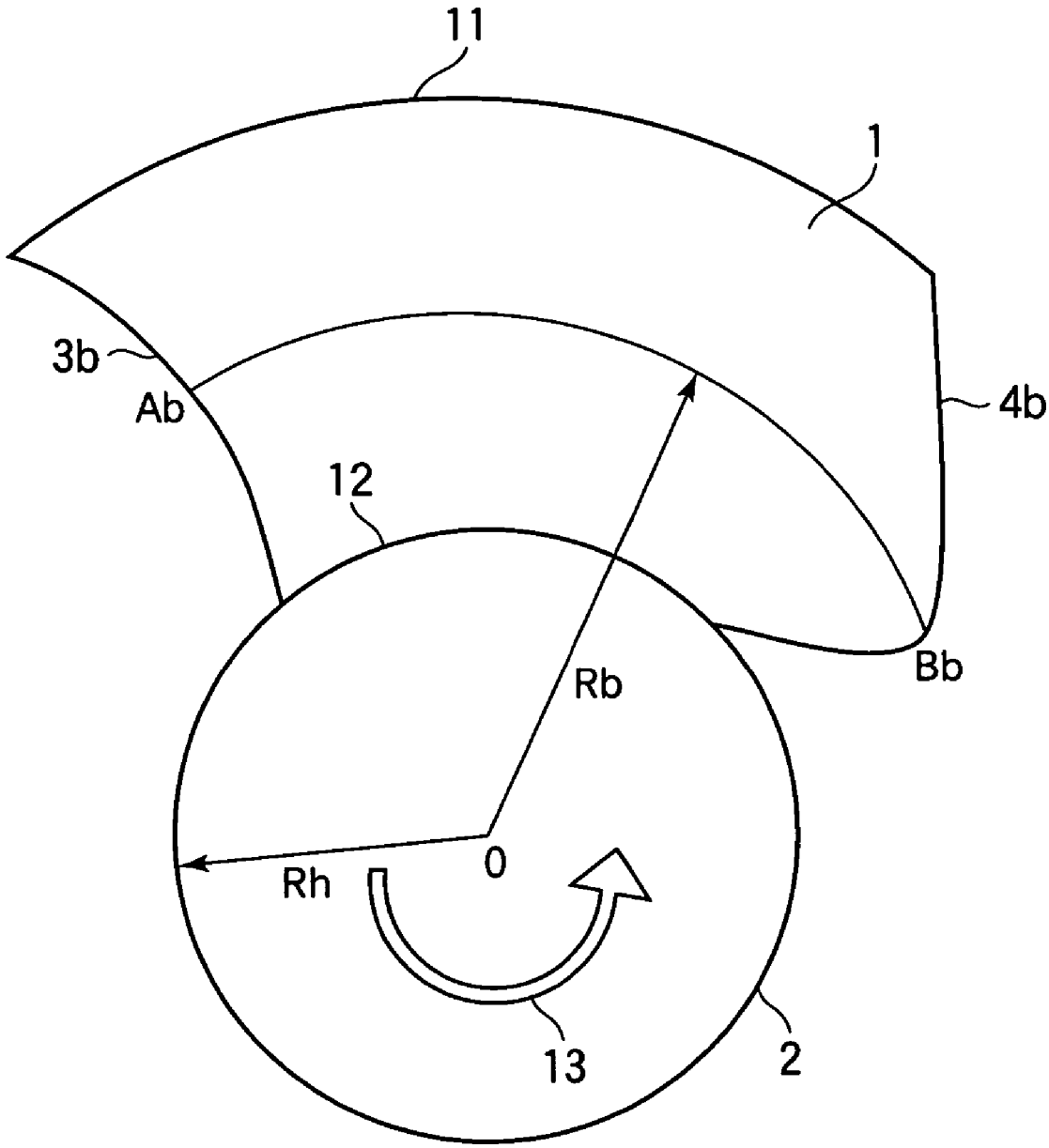
FIG. 7 is a projection of an axial flow fan according to a second embodiment projected on a plane perpendicular to the rotation axis.

FIG. 7 is a projection of an axial flow fan according to a second embodiment projected on a plane perpendicular to the rotation axis.

The chord-pitch ratio σ which is the ratio of the chord L at the radius R shown in FIG. 2 to the pitch T of the circumference at the radius R divided by the blade number Z (=2πR/Z) is defined as σ=L/T.

In the second embodiment, the radius at which the chord-pitch ratio σ is maximum in FIG. 7 and the radius at which the setting angle is maximum in FIG. 2 have a substantially identical value of Rb.

Generally, the range of the attack angle αA applicable in the blade profile becomes extensive when the chord-pitch ratio σ is large (for example, refer to Non-Patent Document 1 P379). Therefore, if the present embodiment is employed, the axial flow fan can be efficiently operated even when the attack angle αA is large.

Further, the radius Rb is preferably identical as in the second embodiment. However, it may be slightly deviated from each other due to the convenience of the device design and manufacturing errors. The advantage of the present invention can be demonstrated so long as the radius Rb is between 60% and 80% of the outside diameter of the impeller.

Third Embodiment

Figure 8:
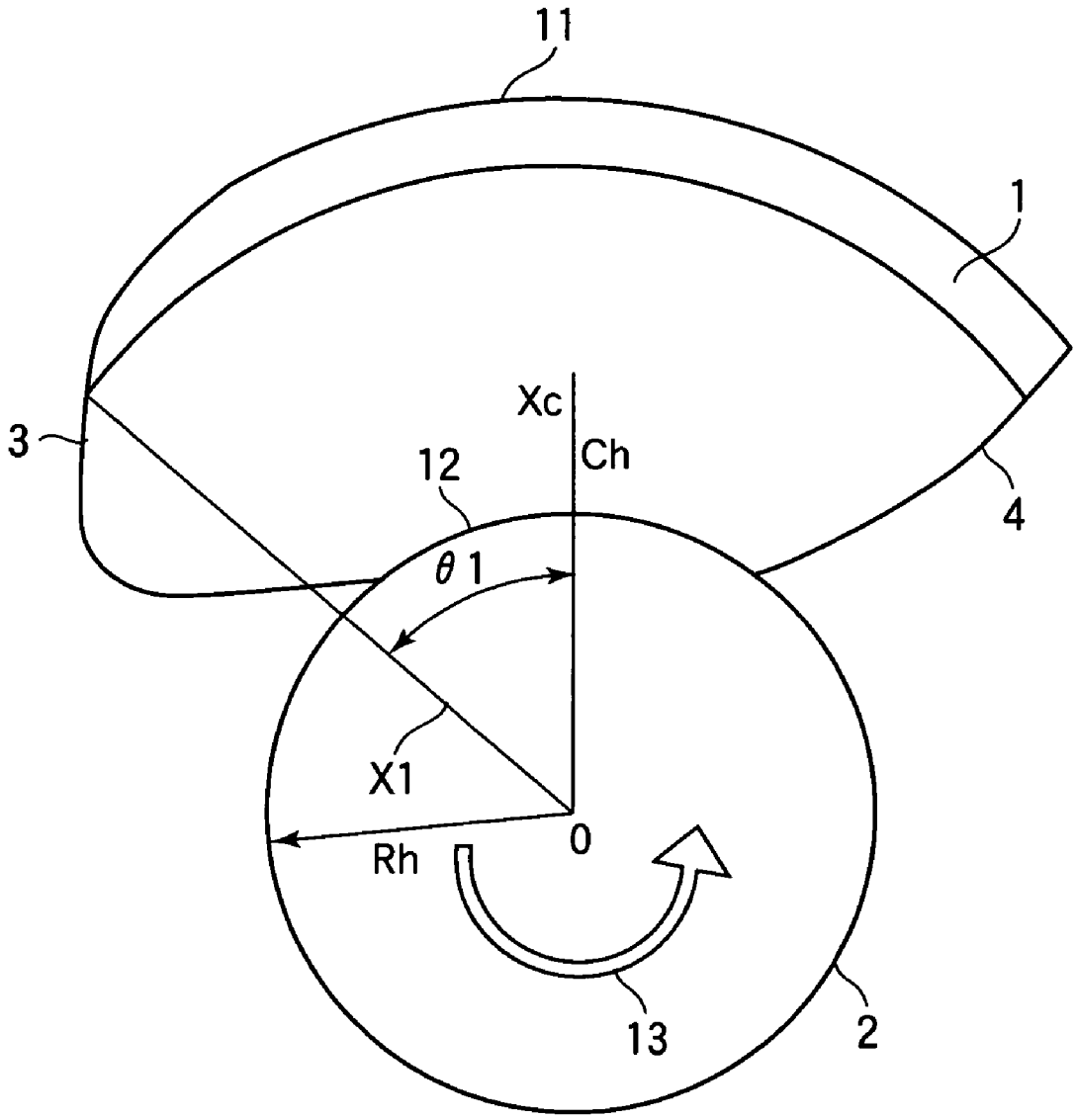
FIG. 8 is a projection of an axial flow fan according to a third embodiment projected on a plane perpendicular to the rotation axis, and illustrates an example of a method for defining the distribution of a leading edge contour 3.

FIG. 8 is a projection of an axial flow fan according to a third embodiment projected on a plane perpendicular to the rotation axis, and illustrates an example of a method for defining the distribution of the leading edge contour 3.

The axial flow fan according to the third embodiment is a combination of the first embodiment with the second embodiment.

In FIG. 8, the leading edge sweep angle θ1 is defined as an angle formed by the line Xc to connect the middle point Ch of the hub contour 12 in the section of the hub portion by the cylindrical surface of the radius Rh to the origin O and the line X1 to connect the leading edge A at the cylindrical section at an arbitrary radius R to the origin O.

Figure 9:
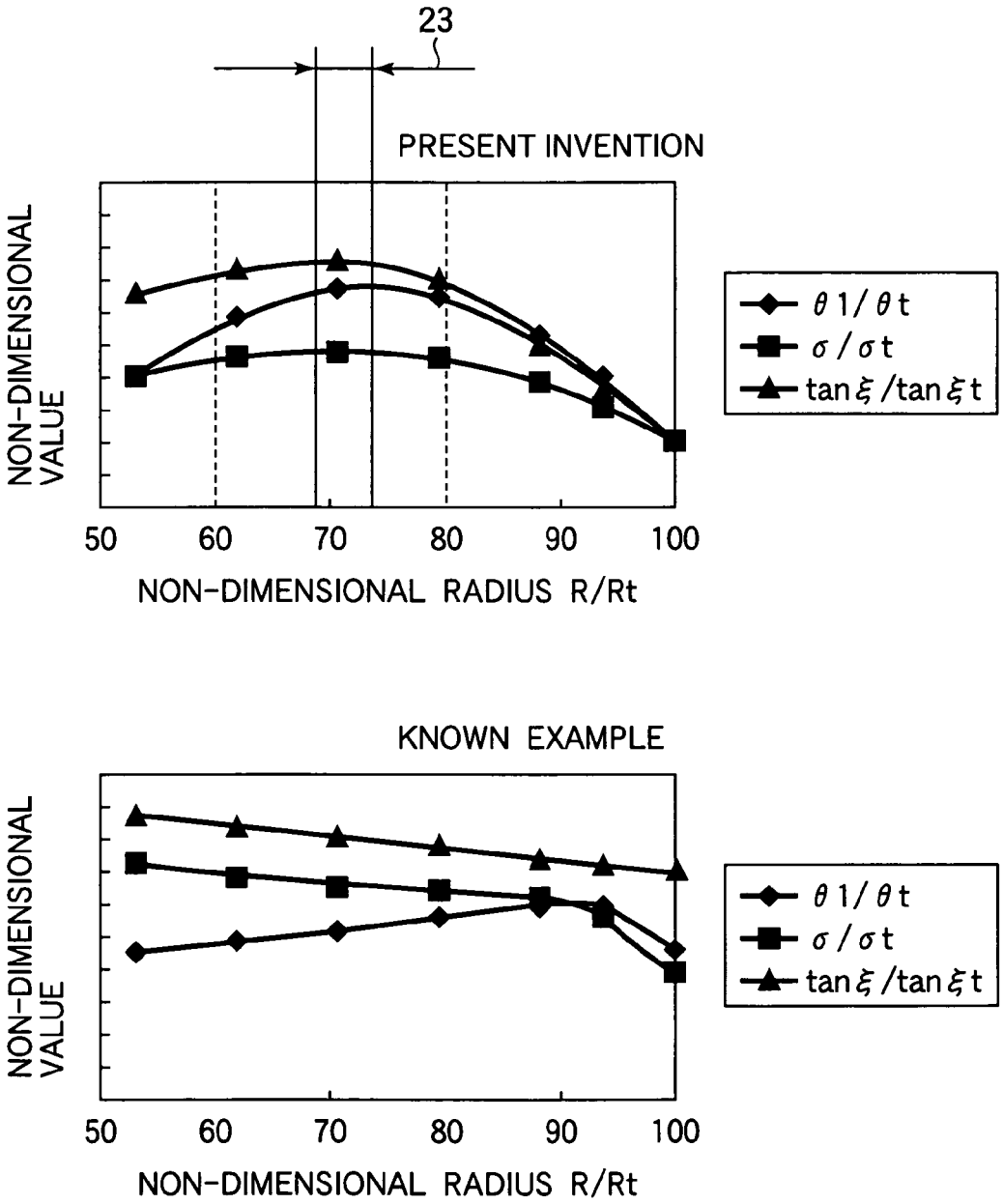
FIG. 9 shows comparison of radial distribution of the leading edge sweep angle θ1, the chord-pitch ratio σ, and the tangent of the setting angle ξ between the axial flow fan according to the third embodiment and an axial flow fan of a known design.

FIG. 9 shows comparison of radial distribution of the leading edge sweep angle θ1, the chord-pitch ratio σ, and the tangent of the setting angle ξ between the axial flow fan according to the third embodiment and an axial flow fan of a known design. The suffix t denotes the tip portion, and in FIG. 9, these values are shown in a non-dimensional manner at the tip portion.

In FIG. 9, the radius with maximum θ1, σ and tanξ in the third embodiment is substantially identical in the range 23 while the radius with a known axial flow fan is monotone increasing or monotone decreasing.

The smaller range 23 is preferable. The advantage of the present invention can be sufficiently obtained if the range of the third embodiment is available. However, the idealistic range 23 is 60%–80% of the outside diameter of the impeller.

Figure 10:
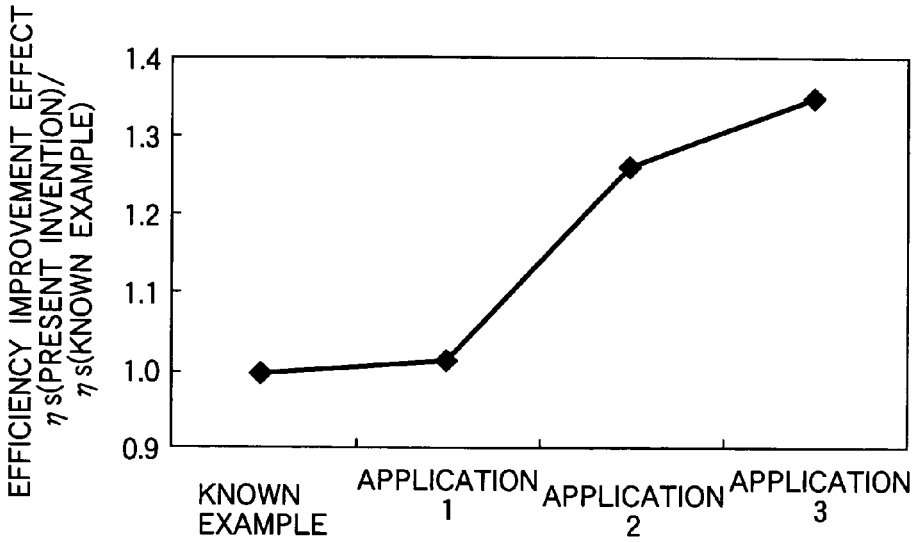
FIG. 10 shows comparison of the efficiency of the axial flow fan according to the third embodiment with the efficiency of an axial flow fan of a known design.

FIG. 10 shows comparison of the efficiency of the axial flow fan according to the third embodiment with the efficiency of an axial flow fan of a known design.

FIG. 10 shows a plurality of examples 1 to 3 with the present embodiment applied thereto, which are expressed by the ratio of the highest static pressure efficiency of the experimentally obtained applications according to the present embodiment to the highest static pressure efficiency with a known axial flow fan. The efficiency of the application of the present invention is more excellent than that of the known example.

Figure 11:
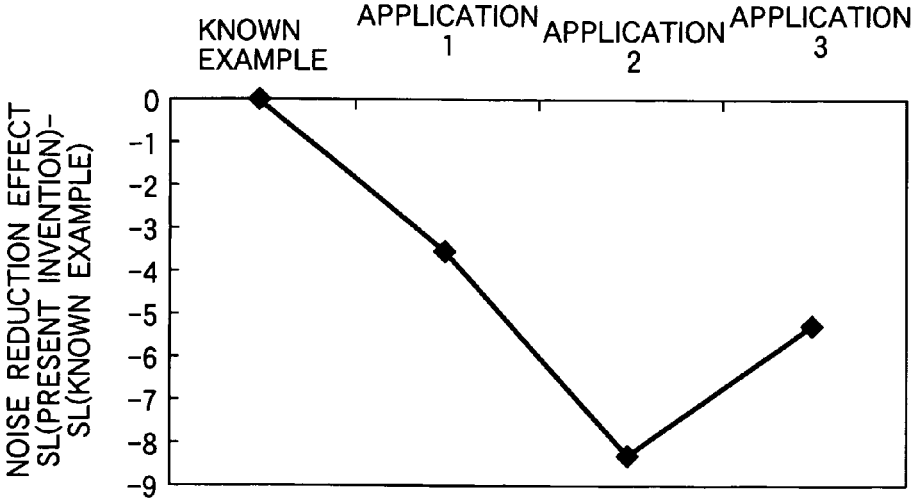
FIG. 11 shows a noise reduction effect of the axial flow fan according to the third embodiment compared with an axial flow fan of a known design.

FIG. 11 shows a noise reduction effect of the axial flow fan according to the third embodiment compared with an axial flow fan of a known design. FIG. 11 expresses the difference between the experimentally obtained noise level of the known example and that of the application of the present invention. The noise level is an experimental value at the flow rate at the highest static pressure efficiency point, and evaluated after conversion in the specific noise level. As shown in FIG. 11, the noise level is reduced in the application of the present invention compared with that of the known example.

Fourth Embodiment

Figure 12:
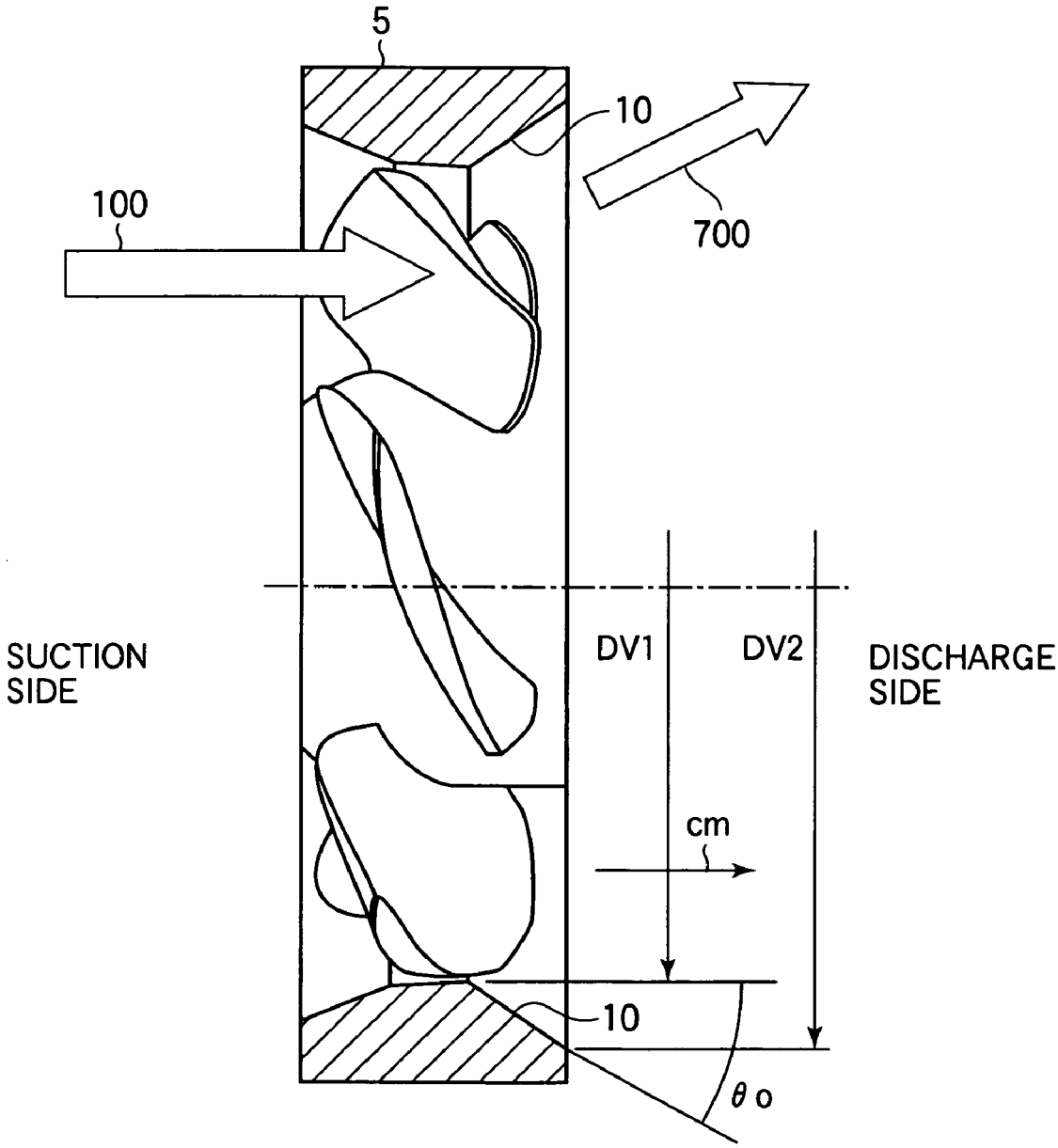
FIG. 12 is a sectional view of a structure of an axial flow fan casing.

FIG. 12 is a sectional view of a structure of an axial flow fan casing cut by the plane including the rotation axis. In FIG. 12, an air outlet on the discharge side of the fan casing 5 is constituted of a conical surface 10 communicated with an opening end in an expanding manner. The conical surface 10 is formed at the angle θ0 to a line parallel to the rotation axis.

In FIG. 6 of the first embodiment, the flow on the discharge side is inclined outwardly in the radial direction by the balance between the pressure gradient and the flow. In the fourth embodiment, the conical surface 10 is formed along the inclined flow.

A flow 700 in FIG. 12 flows out at the angle θ0 along the conical surface 10 without any collision with the fan casing. As a result, losses caused by the collision of the flow 700 with the fan casing are reduced. In addition, the inside diameter of the fan casing is increased from DV1 to DV2, and the component Cm of the axial flow velocity parallel to the rotation axis is reduced.

Generally, the loss of air discharged from the opening end to a wide space (a so-called discharge loss) is proportional to the square of Cm. Therefore, the fourth embodiment has an effect of reducing discharge losses.

Here, the air outlet is constituted of the conical surface 10. However, it is not limited to the conical surface so long as the surface does not cause any trouble for the flow 700.

Fifth Embodiment

Figure 13:
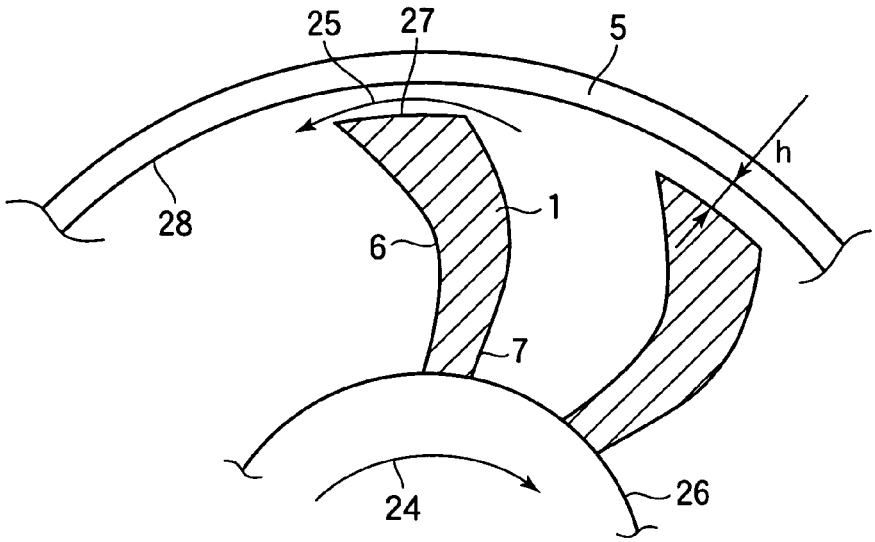
FIG. 13 is a sectional view of an axial flow fan according to a fifth embodiment cut by a plane perpendicular to the rotation axis.

FIG. 13 is a sectional view of the axial flow fan according to a fifth embodiment cut by the plane perpendicular to the rotation axis. Since the blades 1 are rotated in a direction of an arrow 24, the right side of the plane of the figure forms the pressure surface 7 and the left side thereof forms the suction surface 6.

An adequate tip clearance h is ensured between a blade end face 27 of the blade 1 and an inner surface 28 of the fan casing 5 so that the blades 1 can be rotated.

Figure 14:
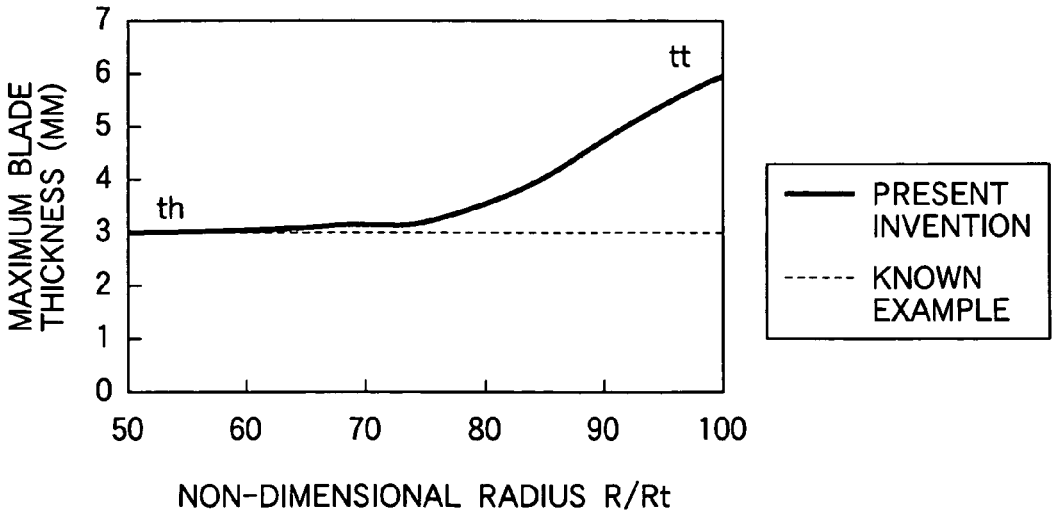
FIG. 14 shows comparison of a maximum blade thickness t of the axial flow fan according to the fifth embodiment with a maximum blade thickness t of an axial flow fan of a known design.

FIG. 14 shows comparison of the maximum blade thickness t (refer to FIG. 2) of the axial flow fan according to the fifth embodiment with the maximum blade thickness t of an axial flow fan of a known design.

The thickness t of the known example has been constant. On the other hand, in the fifth embodiment, the thickness tt at the tip portion radius Rt is larger than the thickness th at the radius Rh of the hub portion.

When the blades 1 are rotated, pressure difference is generated between the pressure surface 7 and the suction surface 6, the flow indicated by an arrow 25 is formed in the tip clearance h.

Generally, in a known design, the ratio of covering the flow passage by the blades is smaller and the increase in the flow velocity is smaller as the maximum blade thickness t is smaller. Therefore, it has been considered the flow passage loss is small and high efficiency is enhanced.

On the other hand, in the present invention, the thickness tt at the radius Rt is increased, and the flow indicated by the arrow 25 is reduced.

A part of the losses and noise occurring in the tip portion are caused by the flow indicated by the arrow 25, and suppression of these values contributes to high efficiency and low noise level.

Sixth Embodiment

Figure 15:
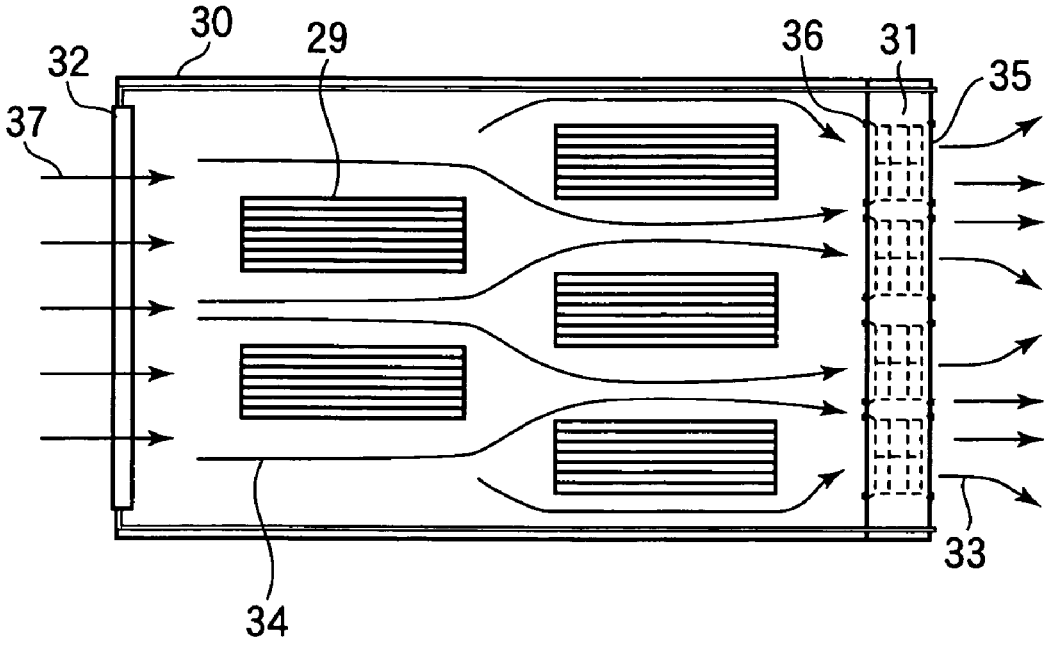
FIG. 15 shows the inside of a device casing with the axial flow fan according to any one of the first to fifth embodiments assembled with the device.

FIG. 15 shows the inside of a device casing with the axial flow fan according to any one of the first to fifth embodiments assembled with the device.

An axial flow fan 31 is installed on one surface of a casing 30, and an inlet 32 is formed in a surface on the opposite side. The axial flow fan 31 is installed so that a fan inlet 36 is located inside the casing 30, and a fan outlet 35 is located outside the casing 30. A heating body 29 such as a printed circuit board is placed inside the casing 30.

In the sixth embodiment, the axial flow fan 31 is operated to cool the heating body 29. Air is fed inside the casing 30 as indicated by an arrow 37 from the inlet 32, and passed through the heating body 29 as indicated by an arrow 34 to cool the heating body 29.

Air after cooling the heating body 29 is sucked from the fan inlet 36 in the axial flow fan 31, and boosted by an impeller (not shown), and discharged into the atmosphere from the fan outlet 35.

Flow passage losses occur when air passes through the inlet 32 and the heating body 29 in the casing 30. The axial flow fan 31 is operated with the flow rate to produce the pressure overcoming the flow passage losses.

As shown in FIG. 6 of the first embodiment and FIG. 12 in the third embodiment, the flow discharged from the axial flow fan of the present invention is slightly inclined in the centrifugal direction as shown by an arrow 33. However, the flow on the fan inlet 36 side is substantially parallel to the rotation axis.

Therefore, as shown in the sixth embodiment, when an object to be cooled is placed on the fan inlet 36 side, a high cooling effect can be demonstrated, and a device of high efficiency and low noise level with the axial flow fan assembled therewith can be obtained.

Seventh Embodiment

Figure 16:
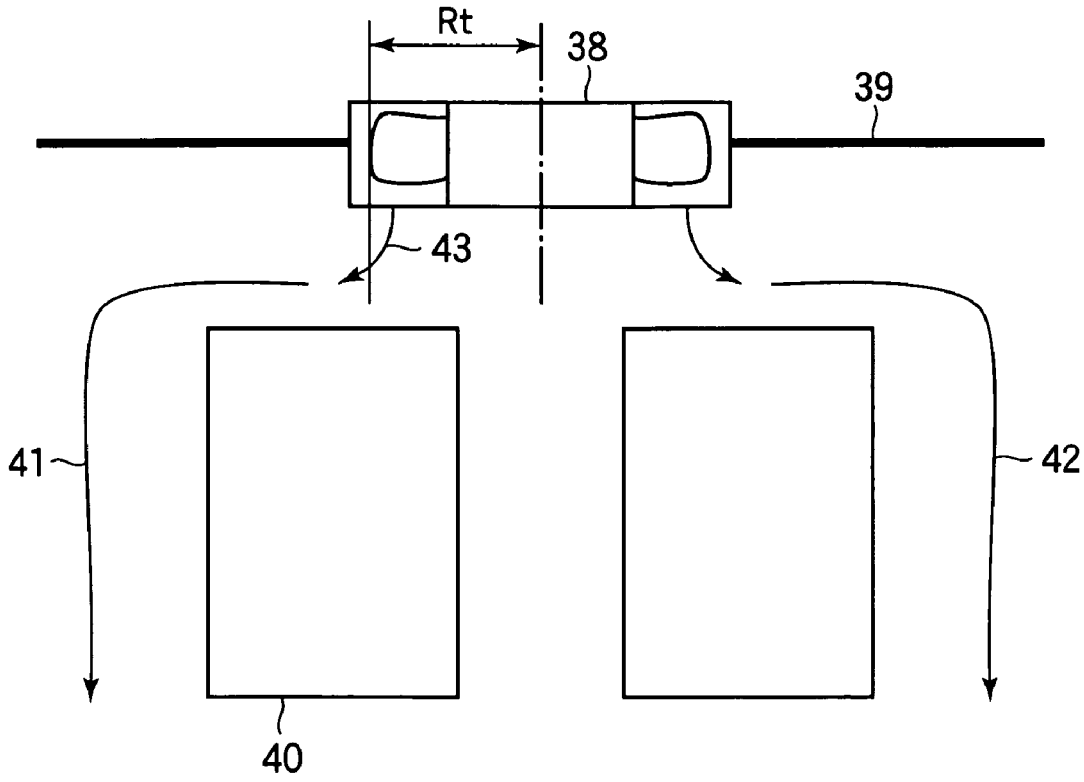
FIG. 16 shows a positional relationship between the axial flow fan according to any one of the first to fifth embodiments and a heating body disposed on a discharge side thereof.

FIG. 16 shows a positional relationship between the axial flow fan according to any one of the first to fifth embodiments and the heating body disposed on the discharge side thereof.

An axial flow fan 38 is fitted to a wall 39 of the casing. A heating body 40 is projected from the tip portion radius Rt of the axial flow fan 38.

As shown in FIG. 6 of the first embodiment and FIG. 12 in the third embodiment, the flow discharged from the axial flow fan of the present invention is slightly inclined in the centrifugal direction as shown by an arrow 43. Thus, by disposing a heating body 40 as shown in FIG. 16, the flows 41 and 42 smoothly flow outward around the heating body 40, and sufficient cooling effect can be obtained.

Eighth Embodiment

Figure 17:
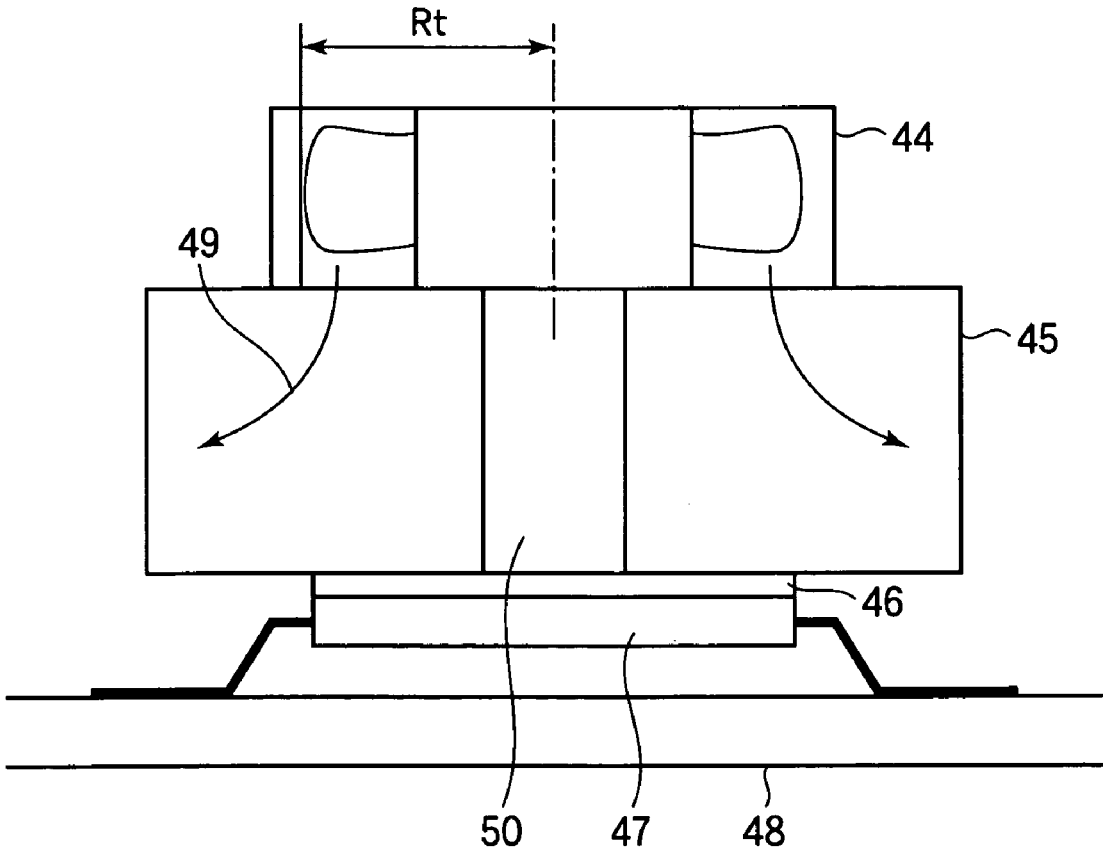
FIG. 17 shows a structure of a heat sink with a fan to directly cool a high-temperature heating element by integrating the heat sink with the fan.

FIG. 17 shows the structure of a heat sink with a fan to directly cool a high-temperature heating element by integrating the heat sink with the fan.

A heating element 47 is fitted to a printed circuit board 48. A heat sink 45 is in contact with the heating element 47 via a heat connection member 46. An axial flow fan 44 of the present embodiment is placed on the heat sink 45. The heat from the heating element 47 is transferred to the heat connection member 46, and reaches the heat sink 45.

The heat sink 45 is projected from the tip radius Rt at the outlet side of the axial flow fan 44. A plurality of heat sinks 45 may be provided with a space 50 therebetween, or the single integrated heat sink may be provided.

As shown in FIG. 6 of the first embodiment and FIG. 12 in the third embodiment, the flow discharged from the axial flow fan of the present invention is slightly inclined in the centrifugal direction as indicated by an arrow 49. By installing the high-temperature heating element as shown in FIG. 17, the flow is sufficiently distributed in the heat sink 45 to radiate the heat.

A high heating effect can be obtained by improving the arrangement of the axial flow fan and/or the heating body even when an object to be cooled is on the fan outlet side like the heat sink with the axial flow fan in the eighth embodiment, and devices of high efficiency and low noise level with the axial flow fan assembled therewith can be realized.

What is claimed is:

1. An axial flow fan comprising:

a motor;

an impeller having a plurality of blades around a hub fitted to the motor; and a fan casing having an air inlet on one side and an air outlet on the other;

wherein a radial position with a maximum setting angle $\xi$ in a blade section, and a radial position Aa with a contour of a leading edge portion in a fluid flowing direction forming a projecting apex in the flowing direction are located between 60% and 80% of the outside diameter of the impeller.

2. An axial flow fan according to claim 1;

wherein the air outlet of the fan casing has an inner surface communicating with an opening end in an expanding manner.

3. An axial flow fan according to claim 1;

wherein a maximum blade thickness tt of a tip portion is larger than a maximum blade thickness th of a hub part when the blade is cut by a cylindrical plane of the radius R, and the section is expanded in a two-dimensional plane.

4. An axial flow fan according to claim 1;

wherein the air outlet of the fan casing has an inner surface communicating with an opening end in an expanding manner; and a maximum blade thickness tt of a tip portion is larger than a maximum blade thickness th of a hub part when the blade is cut by a cylindrical plane of the radius R, and the section is expanded in a two-dimensional plane.

5. An axial flow fan comprising:

a motor;

an impeller having a plurality of blades around a hub fitted to the motor; and a fan casing having an air inlet on one side and an air outlet on the other;

wherein a radial position with a maximum setting angle $\xi$ in a blade section, and a radial position with a maximum chord-pitch ratio $\sigma$ when the chord-pitch ratio $\sigma$ is defined as $\sigma=L/T$, where L is a length of a chord line to connect a leading edge to a trailing edge of the blade, and T is a pitch of a circumferential length at the radius R divided by the blade number Z, are located between 60% and 80% of the outside diameter of the impeller.

6. An axial flow fan according to claim 5;

wherein the air outlet of the fan casing has an inner surface communicating with an opening end in an expanding manner.

7. An axial flow fan according to claim 5;

wherein a maximum blade thickness tt of a tip portion is larger than a maximum blade thickness th of a hub part when the blade is cut by a cylindrical plane of the radius R, and the section is expanded in a two-dimensional plane.

8. An axial flow fan according to claim 5;

wherein the air outlet of the fan casing has an inner surface communicating with an opening end in an expanding manner; and a maximum blade thickness tt of a tip portion is larger than a maximum blade thickness th of a hub part when the blade is cut by a cylindrical plane of the radius R, and the section is expanded in a two-dimensional plane.

9. An axial flow fan comprising:

a motor;

an impeller having a plurality of blades around a hub fitted to the motor; and a fan casing having an air inlet on one side and an air outlet on the other;

wherein a radial position with a maximum setting angle $\xi$ in a blade section, a radial position Aa with a contour of a leading edge portion in a fluid flowing direction forming a projecting apex in the flowing direction, and a radial position with a maximum chord-pitch ratio $\sigma$ when the chord-pitch ratio $\sigma$ is defined as $\sigma=L/T$, where L is a length of a chord line to connect a leading edge to a trailing edge of the blade, and T is a pitch of a circumferential length at the radius R divided by the blade number Z, are located between 60% and 80% of the outside diameter of the impeller.

10. An axial flow fan according to claim 9;

wherein the air outlet of the fan casing has an inner surface communicating with an opening end in an expanding manner.

11. An axial flow fan according to claim 9;

wherein a maximum blade thickness tt of a tip portion is larger than a maximum blade thickness th of a hub part when the blade is cut by a cylindrical plane of the radius R, and the section is expanded in a two-dimensional plane.

12. An axial flow fan according to claim 9;

wherein the air outlet of the fan casing has an inner surface communicating with an opening end in an expanding manner; and a maximum blade thickness tt of a tip portion is larger than a maximum blade thickness th of a hub part when the blade is cut by a cylindrical plane of the radius R, and the section is expanded in a two-dimensional plane.

13. A method for using an axial flow fan, the fan comprising a motor; an impeller having a plurality of blades around a hub fitted to the motor; and a fan casing having an air inlet on one side and an air outlet on the other; a radial position with a maximum setting angle $\xi$ in a blade section, and a radial position Aa with a contour of a leading edge portion in a fluid flowing direction forming a projecting apex in the flowing direction being located between 60% and 80% of the outside diameter of the impeller;

the method comprising arranging an object to be cooled to project at a position of the radius larger than the tip portion radius Rt on the air outlet side of the axial flow fan and operating the axial flow fan.

14. A method for using an axial flow fan, the fan comprising a motor; an impeller having a plurality of blades around a hub fitted to the motor; and a fan casing having an air inlet on one side and an air outlet on the other; a radial position with a maximum setting angle $\xi$ in a blade section, and a radial position with a maximum chord-pitch ratio $\sigma$ being located between 60% and 80% of the outside diameter of the impeller, when the chord-pitch ratio $\sigma$ is defined as $\sigma=L/T$, where L is a length of a chord line to connect a leading edge to a trailing edge of the blade, and T is a pitch of a circumferential length at the radius R divided by the blade number Z, the method comprising arranging an object to be cooled to project at a position of the radius larger than the tip portion radius Rt on the air outlet side of the axial flow fan and operating the axial flow fan.

15. A method for using an axial flow fan, the fan comprising a motor; an impeller having a plurality of blades around a hub fitted to the motor; and a fan casing having an air inlet on one side and an air outlet on the other; a radial position with a maximum setting angle $\xi$ in a blade section, a radial position Aa with a contour of a leading edge portion in a fluid flowing direction forming a projecting apex in the flowing direction, and a radial position with a maximum chord-pitch ratio $\sigma$ being located between 60% and 80% of the outside diameter of the impeller, when the chord-pitch ratio $\sigma$ is defined as $\sigma=L/T$, where L is a length of a chord line to connect a leading edge to a trailing edge of the blade, and T is a pitch of a circumferential length at the radius R divided by the blade number Z, the method comprising arranging an object to be cooled to project at a position of the radius larger than the tip portion radius Rt on the air outlet side of the axial flow fan and operating the axial flow fan.

16. A heat sink with an axial flow fan comprising:

an axial flow fan including a motor; an impeller having a plurality of blades around a hub fitted to the motor; and a fan casing having an air inlet on one side and an air outlet on the other; a radial position with a maximum setting angle $\xi$ in a blade section, and a radial position Aa with a contour of a leading edge portion in a fluid flowing direction forming a projecting apex in the flowing direction being located between 60% and 80% of the outside diameter of the impeller; and a heat sink placed on an outlet side of the axial flow fan at the position projecting from the tip portion radius Rt.

17. A heat sink with an axial flow fan comprising:

an axial flow fan including a motor; an impeller having a plurality of blades around a hub fitted to the motor; and a fan casing having an air inlet on one side and an air outlet on the other; a radial position with a maximum setting angle $\xi$ in a blade section, and a radial position with a maximum chord-pitch ratio $\sigma$ being located between 60% and 80% of the outside diameter of the impeller, when the chord-pitch ratio $\sigma$ is defined as $\sigma=L/T$, where L is a length of a chord line to connect a leading edge to a trailing edge of the blade, and T is a pitch of a circumferential length at the radius R divided by the blade number Z; and a heat sink placed on an outlet side of the axial flow fan at the position projecting from the tip portion radius Rt.

18. A heat sink with an axial flow fan comprising: an axial flow fan including a motor; an impeller having a plurality of blades around a hub fitted to the motor; and a fan casing having an air inlet on one side and an air outlet on the other; a radial position with a maximum setting angle $\xi$ in a blade section, a radial position Aa with a contour of a leading edge portion in a fluid flowing direction forming a projecting apex in the flowing direction, and a radial position with a maximum chord-pitch ratio σ being located between 60% and 80% of the outside diameter of the impeller, when the chord-pitch ratio σ is defined as σ=L/T, where L is a length of a chord line to connect a leading edge to a trailing edge of the blade, and T is a pitch of a circumferential length at the radius R divided by the blade number Z; and a heat sink placed on an outlet side of the axial flow fan at the position projecting from the tip portion radius Rt.

* * * * *